US005291378A

United States Patent [19]

Stone

[11] Patent Number: 5,291,378

[45] Date of Patent: Mar. 1, 1994

[54] FIBER OPTICALLY LIGHTED FOOD DISPENSER VALVE HANDLE ASSEMBLY

[75] Inventor: David H. Stone, Delavan, Wis.

[73] Assignee: Glo-Max Fiber Optic Systems, Inc., Walworth, Wis.

[21] Appl. No.: 901,259

[22] Filed: Jun. 19, 1992

[51] Int. Cl.[5] ..... F21V 7/04

[52] U.S. Cl. ..... 362/32; 362/96; 362/812; 40/547; 222/113

[58] Field of Search ..... 362/32, 22-30, 362/96, 101, 812; 222/113; 40/547

[56] References Cited

U.S. PATENT DOCUMENTS

| | | | |
|---|---|---|---|
| 2,631,393 | 3/1953 | Hetherington | 222/113 |
| 4,745,525 | 5/1988 | Sheehy | 362/32 |
| 4,860,475 | 8/1989 | Levy et al. | 40/547 |
| 4,924,612 | 5/1990 | Kopelman | 40/547 |
| 5,040,320 | 8/1991 | Reidinger | 362/32 |

FOREIGN PATENT DOCUMENTS

| | | | |
|---|---|---|---|
| 146583 | 6/1990 | Japan | 40/547 |

*Primary Examiner*—James C. Yeung
*Attorney, Agent, or Firm*—Potthast & Ring

[57] ABSTRACT

A fiber optically lighted food dispenser valve handle assembly (10) with at least one fiber optic filament (12) with an elongate body extending between a pair of opposite ends (14, 16) means for illuminating (18) including a light source (26) with one of the pair of opposed ends (16) of at least one fiber optic filament (12), a handle grip (20) with an outer surface (22), means at the outer surface (22) such as adhesive material for holding another one of the pair of opposed ends (14) of at least a fiber optic filament (12) to provide end point illumination at the outer surface (22) of the handle grip (20).

18 Claims, 3 Drawing Sheets

FIBER OPTICALLY LIGHTED FOOD DISPENSER VALVE HANDLE ASSEMBLY

BACKGROUND OF THE INVENTION

1. Field of the Invention

This invention generally relates to a fiber optically lighted sign display, and particularly to a fiber optically lighted food dispenser valve handle assembly employing fiber optic lighting to provide end point illumination and back flood lighting to the outer surface of a handle grip of the dispenser valve handle assembly.

2. Description of the related art including information disclosed under 37 CFR 1.97-1.99

Food dispenser valve handle assemblies of the type having an elongate handle body connected with grip handle at one end of the handle body and connected to a valve, such as a draft beer tap valve at an opposite end of the handle body opposite the one end are well known.

The handle grips generally have brand names, logos or both on their outer surface that indicate the affiliation of the product being dispensed by actuation of the valve handle assembly. However, since known handle grips are not illuminated, their visibility and thus suitability as advertising media is substantially reduced relative to back lit advertising signs, fiber optic signs and the like.

SUMMARY OF THE INVENTION

It is therefore the principal object of this invention to provide a back lit food dispenser valve handle assembly preferably employing fiber optic filaments for providing illumination at the outer surface of the handle grip of the dispenser valve handle assembly preferably in the form of end point illumination, flood back lighting or both to overcome the aforementioned disadvantages of known food dispenser valve handle assemblies.

This objective is achieved through provision of a fiber optically lighted food dispenser valve handle assembly having at least one fiber optic filament with an elongate body extending between a pair of opposed ends, means for illuminating one of the pair of opposed ends of the at least one fiber optic filament, a handle grip with an outer surface, means at the outer surface for holding another one of the pair of opposed ends of the at least one fiber optic filament to provide end point illumination at the outer surface of the handle grip, means including a handle body connectable with the handle grip at one end of the handle body and connectable to a valve at another end of the handle body opposite the one end, and means for mounting at least a part of the elongate fiber optic body extending between the filament end holding means and the illuminating means to the handle body for movement with the handle body and handle grip.

In the preferred embodiment, a plurality of fiber optic filaments are arranged at the handle grip surface to form a message, logo or other graphic depiction in end point illumination. In addition or alternatively, a portion of the handle grip is made of light transmittable (i.e. translucent, transparent or both) material which is flood back lit by means of other fiber optic cables.

BRIEF DESCRIPTION OF DRAWING

The foregoing objects and advantageous features of the invention will be explained in greater detail and others will be made apparent from the detailed description of the preferred embodiment of the present invention which is given reference to the several figures of the drawing, in which.

DETAILED DESCRIPTION

Figure 1:
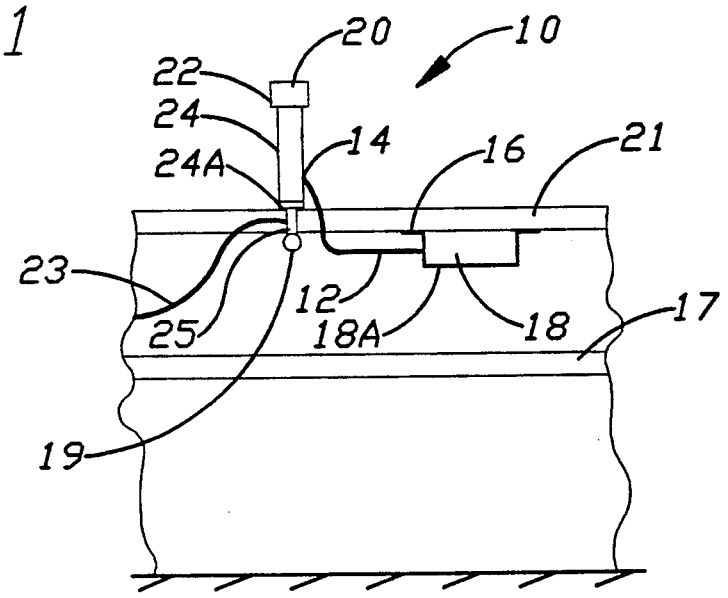
FIG. 1 is a schematic frontal view of the preferred embodiment of the fiber optically lighted food dispenser valve handle assembly of the present invention employed as a beer tap handle mounted to a bar.

Referring now to FIG. 1, the preferred embodiment of the fiber optically lighted food dispenser valve handle assembly 10 of the present invention is seen to include a plurality of fiber optic filaments 12 each with an elongate body extending between a pair of opposed ends 14 and 16, an illuminator subassembly 18 for illuminating opposed ends 16 of the fiber optic filaments 12, a handle grip 20 with an outer surface 22 and an elongate handle body 24. The valve handle body 24 has a threaded end 24A for releasable connection to a valve actuator, or valve, 25 connected to a remote supply of beverage, such as beer, connected to the valve 25 by means of a tube 23. As shown in FIG. 1, the valve 25 is mounted to a rearward edge bar tap 21 with the illuminator subassembly 18 contained within a water and moisture resistant protective housing 18A mounted beneath the bar and safely spaced laterally from a beverage outlet 19 and above a work counter and sink to 17.

Figure 2:
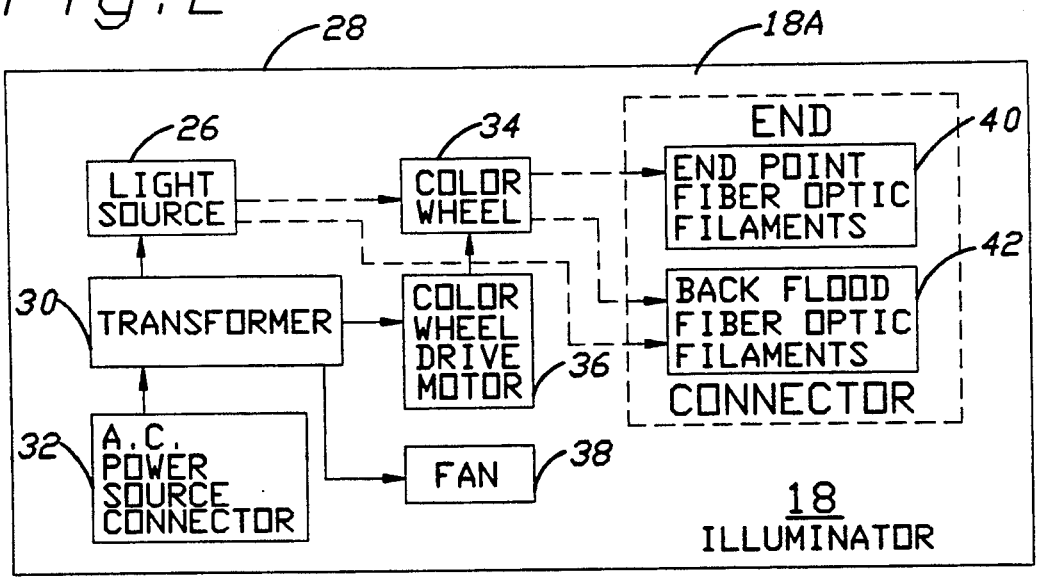
FIG. 2 is a functional block diagram of the preferred embodiment of the illuminator subassembly of the fiber optically lighted food dispenser valve handle assembly of FIG. 1.

Referring now to FIG. 2, the illuminator 18 includes within moisture resistant housing 18A a remote light source 26, protectively resistant, preferably a halogen lamp, which receives power from a transformer 30 connected with suitable source of AC power (not shown) through an AC power source connector.

The fiber optically lighted food dispenser valve handle assembly 10 preferably has a plurality of two different groups of fiber optic filaments 12: end point fiber optic filaments 40 the ends of which are mounted to the handle grip 20 for end point illumination and back flood fiber optic filaments 42 mounted relative to the grip 20 for back flood lighting.

This spaced arrangement between the illuminator 18 and the AC powered electronics contained within protective housing 18A enables the handle grip 20 to be back lit either with flood lighting or end point fiber optic lighting substantially safe from electrical shocking caused by liquids from the outlet 19 or water from the sink 17 or the like. While the illuminator is shown mounted beneath the same bar 16, it could be located in even more remote and thus even more protectable locations, but this will increase the length and thus cost of the fiber optic filaments 12. The body of the fiber optic filaments between the opposite outlet end 14 and inlet end 16 preferably partially wrapped together in a plastic flexible sheath which is also preferably mounted beneath the bar tap 21 at any convenient location.

Most importantly, the only contact of the illuminator 18 with the handle grip 20 and handle body 24 is via the nonelectroconductive fiber optic filaments. There is no electrical connection or possible electrical contact with the valve 25, handle body 24 and handle grip 20 thereby substantially reducing the risk of electrical shock to operators of the valve 12 relative to illumination via electrical lighting in electrical contact with the valve 25.

In keeping the object of the invention, the housing 28 also protectively contains a color wheel 34 for varying the color of the light conveyed by the fiber optic filament 12 or conveyed by the end point fiber optic filaments 40 and/or back flood fiber optic filaments 42. A color wheel drive motor 36 functions to drive the color wheel 34 to rotate and thereby partially change the spectrum of the lights conveyed to at least one elongate fiber optic filament 12. In addition, the transformer 30 is connected to both power the color wheel drive motor 36 but also an electrical fan 38. Alternatively, the light source 26 does not pass through the color wheel 34 to convey light to the fiber optic filament 12 or to the end point fiber optic filaments 40 and/or back flood fiber optic filaments 42. In such case the light source 26 bypasses the color wheel 34.

Figure 3:
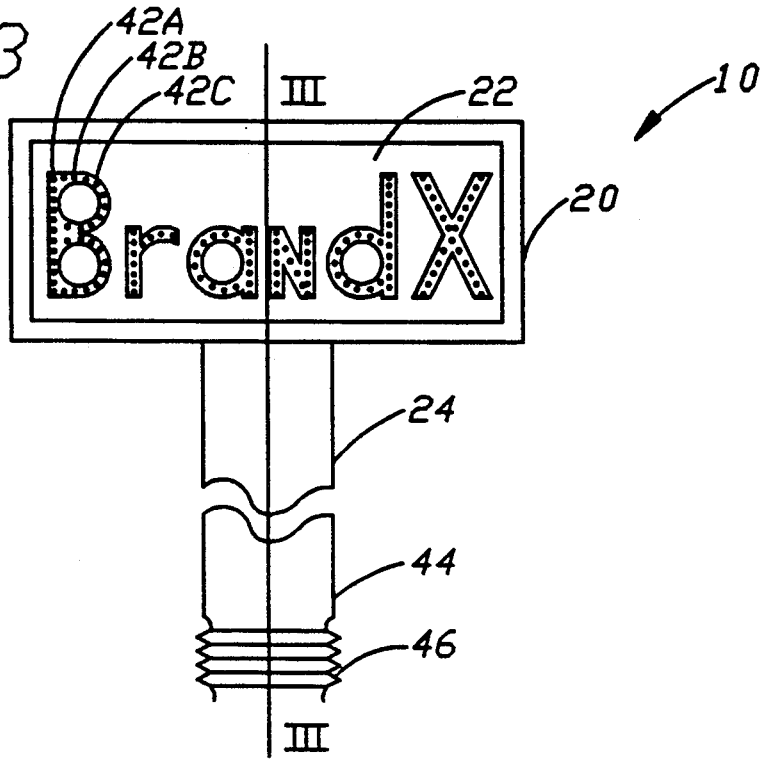
FIG. 3 is an enlarged frontal view of a portion of the preferred embodiment of the grip and part of the body fiber optically lighted food dispenser valve handle assembly.

Referring now to FIG. 3, the fiber optically lighted food dispenser valve handle assembly 10 having means including a handle body 24 connectable with the handle grip 20 at one end of the handle body 24 and connectable to a valve 44 at another end of the handle body 24 opposite the one end by means such as a screw 46 or other suitable means commonly known in the field.

Figure 4A:
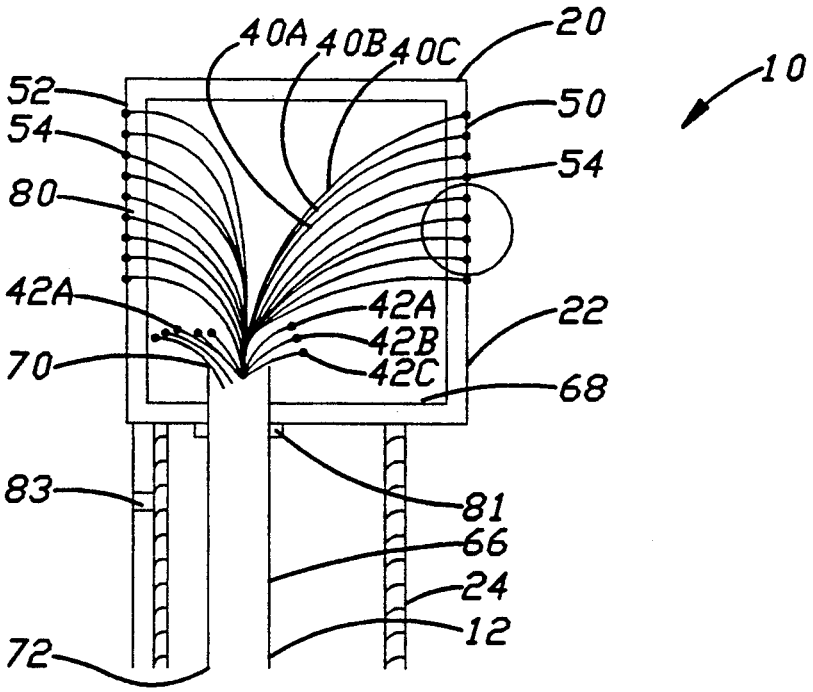
FIG. 4A is a cross sectional side view of the preferred embodiment of the fiber optically lighted food dispenser valve handle assembly taken along sectional line IVA—IVA of FIG. 3.
Figure 4B:
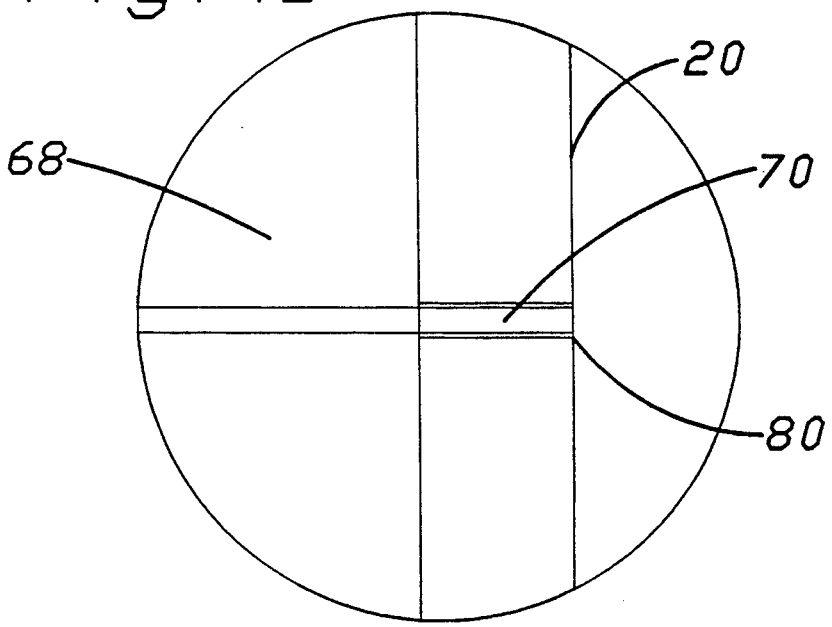
FIG. 4B is an view of the portion of fiber optically lighted food dispenser valve handle assembly as circled in FIG. 4A enlarged to more clearly illustrate the end point mounting of the fiber optic filaments to the handle grip surface.

Referring now to FIG. 4A, the fiber optically lighted valve handle assembly 10 has means for mounting at least part of the elongate fiber optic filament body 12 extending between the filament end holding means 80 and the illuminating means 12 to the handle body 24 for movement with the handle body 24 and handle grip 20. Preferably, the body 12 is protectably mounted within the handle body at 81 or is mounted along the side of body 12 at 83. Clips are the suitable means. The invention also includes the outer surface 22 for holding one of the pair of opposed ends 14 of the at least one fiber optic filament 12 to provide end point illumination at the outer surface 22 of the handle grip 20. Said outer surface 22 of the handle grip 20 has a front 50 and a back 52. The fiber optic filament holding means 54 can be located on the front side 50 of the handle grip 20.

In keeping with the object of the invention, the fiber optically lighted food dispenser valve handle assembly 10 includes a plurality of fiber optic filaments 12 connected with said outer surface 22, preferrably with a pair of opposed sides, 50, 52, including means for holding the ends of the plurality of fiber tie filaments, 40*a*, 40*b*, 40*c*, to provide end point illumination at the surface 22 of both the opposed sides, 50 and 52 of the manual handle grip 20.

In keeping with the object of the invention, said handle body 24 has a passageway 66 extending through the handle body 24 which includes mounting means 81 for protectively mounting the elongate fiber optic filament 12 within the passageway 66. Alternatively, they are mounted on the outside by clips. Said handle grip 20 has a hollow portion 68 and said passageway 66 has one end 70 opening into said hollow portion 68 and another end 72 adjacent and end of the handle body 24 opposite the handle grip 20. The handle body 24 is elongate and the other end 70 of the passageway 66 opens in a lateral direction relative to the handle body 24.

The fiber optically lighted food dispenser valve handle assembly 10 has a portion of the handle grip surface 22 being made of light transmittable material such as clear plastic and includes means for back flood lighting of the light transmittable portion of the handle grip 20 from within the handle grip 20. The back flood means includes at least one other fiber optic filament 42 having an end spaced from the bundle grip surface 22 for flood lighting the light transmittable portion from within the handle grip 20.

In addition, the back flood means includes a plurality of fiber optic filaments 42*a*, 42*b*, 42*c*, for conveying light from the illuminating means 18 to a plurality of end points mounted at the surface of the handle grip. Said plurality of end points 42*a*, 42*b* and 42*c* are mounted at the surface of the handle grip 22 in an arrangement which forms a message as shown in FIG. 3 and preferably held in place by friction adhesive.

While a preferred embodiment has been disclosed, it should be appreciated that the scope of invention is defined in the appended claims.

I claim:

1. A fiber optically lighted food dispenser valve handle assembly, comprising:

at least one fiber optic filament with an elongate body extending between a pair of opposed ends;

means for illuminating one of the pair of opposed ends of the at least one fiber optic filament;

a handle grip with an outer surface;

means at the outer surface for holding another of the pair of opposed ends of the at least one fiber optic filament to provide end point illumination at the outer surface of the handle grip;

means for holding including a handle body connectable with the handle grip at one end of the handle body and connectable to a valve at another end of the handle body opposite the one end; and means for mounting at least a part of the elongate fiber optic body extending between the filament end holding means and the illuminating means to the handle body for movement with the handle body and handle grip.

2. The fiber optically lighted food dispenser valve handle assembly of claim 1 in which said outer surface of the handle grip has a front and a back, and the fiber optic filament holding means is located on the front side of the handle grip.

3. The fiber optically lighted food dispenser valve handle assembly of claim 1 in which there are a plurality of said at least one fiber optic filament, said outer surface has a pair of exposed sides, and said holding means includes means for holding the end of the fiber and the filament to provide end point illumination at both of the exposed surfaces of the manual handle grip.

4. The fiber optically lighted food dispenser valve handle assembly of claim 1 in which said handle body has a passageway extending through the handle body, and said mounting means includes means for protectively mounting the elongate fiber optic body within the passageway.

5. The fiber optically lighted food dispenser valve handle assembly of claim 4 in which said handle grip has a hollow portion, and said passageway has one end opening into said hollow portion and another end adjacent an end of the handle body opposite the handle grip.

6. The fiber optically lighted food dispenser valve handle assembly of claim 5 in which the handle body is elongate, and the other end of the passageway opens in a lateral direction relative to the handle body.

7. The fiber optically lighted food dispenser valve handle assembly of claim 1 in which a portion of the handle grip surface is made of light transmittable material, and including means for back flood lighting of the light transmittable portion of the handle grip from within the handle grip.

8. The fiber optically lighted food dispenser valve handle assembly of claim 7 in which said back flood lighting means includes at least one other fiber optic filament having an end spaced from the handle grip surface for flood lighting the light transmittable portion from within the handle grip.

9. The fiber optically lighted food dispenser valve handle assembly of claim 8 in which said back flood lighting means includes a plurality of fiber optic filaments for conveying light from the illuminating means to a plurality of end points mounted at the surface of the handle grip.

10. The fiber optically lighted food dispenser valve handle assembly of claim 9 in which said plurality of end points are mounted at the surface of the handle grip in an arrangement which forms a message.

11. The fiber optically lighted food dispenser valve handle assembly of claim 9 in which said illuminating means includes an assembly with a remote light source protectively contained within a housing spaced from, but interconnected with, the handle grip through the at least one elongate fiber optic filament.

12. The fiber optically lighted food dispenser valve handle assembly of claim 11 in which said illuminating means includes means for varying the color of the light conveyed by the fiber optic filament.

13. The fiber optically lighted food dispenser valve handle assembly of claim 1 in which said mounting means includes means for mounting the part of the elongate fiber optic body along a surface of the handle between the valve and the handle grip.

14. The fiber optically lighted food dispenser valve handle assembly of claim 1 in which the valve has an open position and a closed position; and the illuminating means continuously provides end point illumination at the outer surface of the handle grip regardless of the position of the valve.

15. A method of back lighting a food dispenser valve assembly, comprising the steps of:

mounting a handle to the valve assembly with one end of fiber optic filaments attached to back light at least a portion of the handle from light entering distal ends of the filaments;

mounting a source of illumination at a location spaced from the valve assembly; and connecting the distal end of the fiber optic filament adjacent the source of illumination to receive and convey light from the source of illumination, to the handle grip.

16. The method of claim 15 including the step of mounting the illuminating source within a moisture resistant protective casing.

17. The method of claim 15 in which the illuminating means is mounted at a location spaced from the handle grip and is only connected with the handle grip through the fiber optic cable.

18. The method of claim 14 including the step of mounting the illuminating means beneath a counter for increased protection against contact with food from the outlet.

* * * * *